US011162663B2

(12) United States Patent
Kinzer et al.

(10) Patent No.: US 11,162,663 B2
(45) Date of Patent: Nov. 2, 2021

(54) LIGHTING FIXTURE

(71) Applicant: Electronic Theatre Controls, Inc., Middleton, WI (US)

(72) Inventors: David J. Kinzer, Middleton, WI (US); Frank Tornyai, Santa Maria, CA (US)

(73) Assignee: Electronic Theatre Controls, Inc., Middleton, WI (US)

( * ) Notice: Subject to any disclaimer, the term of this patent is extended or adjusted under 35 U.S.C. 154(b) by 0 days.

(21) Appl. No.: 16/587,176

(22) Filed: Sep. 30, 2019

(65) Prior Publication Data

US 2020/0103097 A1 Apr. 2, 2020

Related U.S. Application Data

(60) Provisional application No. 62/740,010, filed on Oct. 2, 2018.

(51) Int. Cl.

| | |
|---|---|
| ***F21V 7/00*** | (2006.01) |
| ***F21V 14/06*** | (2006.01) |
| ***F21V 5/00*** | (2018.01) |
| ***F21V 15/01*** | (2006.01) |
| ***F21K 9/62*** | (2016.01) |

(52) U.S. Cl.

CPC ..... *F21V 14/06* (2013.01); *F21K 9/62* (2016.08); *F21V 5/007* (2013.01); *F21V 7/0008* (2013.01); *F21V 15/01* (2013.01)

(58) Field of Classification Search

CPC .. F21K 9/60–62; F21V 5/007; F21V 7/00–28; F21V 14/06; F21V 15/01

USPC ..... 362/249.02, 296.01, 297–309, 311.02, 362/326–328, 341, 346–350, 551–555

See application file for complete search history.

(56) References Cited

U.S. PATENT DOCUMENTS

| | | | |
|---|---|---|---|
| 6,200,002 | B1 | 3/2001 | Marshall et al. |
| 6,222,623 | B1 | 4/2001 | Wetherell |
| 6,382,803 | B1 | 5/2002 | Arumugasaamy |
| 6,527,411 | B1 | 3/2003 | Sayers |
| 6,536,914 | B2 | 3/2003 | Hoelen et al. |

(Continued)

FOREIGN PATENT DOCUMENTS

WO 2015/138483 A2 9/2015

OTHER PUBLICATIONS

Edwin Diaz, "Prototyping illuminations systems with stock optical components" Photonik International 2012 originally published in German in Photonik Mar. 2012, 4 Pages.

(Continued)

*Primary Examiner* — Jason M Han

(74) *Attorney, Agent, or Firm* — Michael Best and Friedrich LLP

(57) ABSTRACT

A lighting fixture including a light source including an array of light emitting diodes (LEDs) and a reflector including a input end adjacent the array of LEDs and an output end opposite the input end such that the light source emits light through the reflector from the input end through the output end. The reflector further includes a first, a second, a third, and a fourth sidewall that extend from the input end to the output end. The first and the second sidewalls each include an interior surface, the third and the fourth sidewalls each include an interior surface having a reflectivity that is more diffuse than the interior surfaces of the first and second sidewalls. A lens is adjacent the output end of the reflector.

20 Claims, 18 Drawing Sheets

(56) References Cited

U.S. PATENT DOCUMENTS

| | | | | |
|---|---|---|---|---|
| 6,547,416 | B2 | 4/2003 | Pashley et al. | |
| 7,614,767 | B2 | 11/2009 | Zulim et al. | |
| 7,777,955 | B2 | 8/2010 | Cassarly et al. | |
| 7,874,487 | B2 | 1/2011 | Nunnink et al. | |
| 7,946,729 | B2 | 5/2011 | Ivey et al. | |
| 8,292,463 | B2 | 10/2012 | Speier et al. | |
| 8,456,107 | B2 | 6/2013 | Saem | |
| 8,529,103 | B2 | 9/2013 | Tukker et al. | |
| 8,602,601 | B2 | 12/2013 | Khazi et al. | |
| 8,733,949 | B2 | 5/2014 | Chong et al. | |
| 8,814,376 | B2 | 12/2014 | Nicolai et al. | |
| 8,915,612 | B2 | 12/2014 | Kurt et al. | |
| 8,919,994 | B2 | 12/2014 | Wimberly | |
| 9,169,997 | B2 | 10/2015 | Kurt et al. | |
| 9,249,947 | B2 | 2/2016 | Goldstein et al. | |
| 9,746,596 | B2 | 8/2017 | Preston et al. | |
| 9,995,872 | B2 | 6/2018 | Angelini et al. | |
| 10,082,731 | B2 * | 9/2018 | Kawasumi | G02B 27/283 |
| 2006/0215401 | A1 | 9/2006 | Menzel | |
| 2008/0170392 | A1 | 7/2008 | Speier et al. | |
| 2008/0266893 | A1 | 10/2008 | Speier | |
| 2008/0310152 | A1 | 12/2008 | Verbrugh et al. | |
| 2010/0033948 | A1 | 2/2010 | Harbers et al. | |
| 2010/0097802 | A1 * | 4/2010 | Jurik | G02B 19/0066 362/235 |
| 2010/0113101 | A1 | 10/2010 | Adams | |
| 2010/0284201 | A1 | 11/2010 | Alasaanela | |
| 2011/0013389 | A1 | 1/2011 | Willemsen et al. | |
| 2012/0140463 | A1 | 6/2012 | Kinzer et al. | |
| 2013/0155671 | A1 | 6/2013 | Kurt et al. | |
| 2013/0329429 | A1 | 12/2013 | Lowes et al. | |
| 2014/0117877 | A1 | 5/2014 | Mapel et al. | |
| 2015/0362654 | A1 | 12/2015 | Sadasivan et al. | |
| 2016/0018064 | A1 | 1/2016 | Jurik et al. | |
| 2016/0208999 | A1 | 7/2016 | Jurik | |
| 2016/0370529 | A1 | 12/2016 | Angelini et al. | |
| 2017/0146204 | A1 | 5/2017 | Di Trapani et al. | |

OTHER PUBLICATIONS

Intematix, "Mixing Chamber Design Considerations for ChromaLit™ Remote Phosphor Light Sources", Website: http://www.intematix.com/uploads/application%20notes/MixingChamberDesign.pdf, Application Literature dated Dec. 14, 2017, 11 Pages.

Search/Examination Report issued from the United Kingdom Patent Office for related Application No. GB1914135.7 dated Feb. 12, 2020 (7 pages).

Office Action issued from the Germany Patent Office for related Application No. 102019126521.5 dated Jul. 27, 2020 (9 Pages including Statement of Relevance).

F. Wippermann, et al., "Beam homogenizers based on chirped microlens arrays" Optics express May 14, 2007, vol. 15, No. 10, pp. 6218-6231.

Office Action issued from the U.S. Patent Office for related U.S. Appl. No. 16/998,427 dated Jan. 15, 2021 (10 Pages including form 892).

Office Action issued from the United State Patent Office for related U.S. Appl. No. 16/998,427 dated May 14, 2021 (13 Pages).

* cited by examiner

LIGHTING FIXTURE

CROSS-REFERENCE TO RELATED APPLICATIONS

This application claims priority to U.S. Provisional Patent Application No. 62/740,010, filed Oct. 2, 2018, the entire contents of which are hereby incorporated by reference herein.

BACKGROUND

The present invention relates to lighting fixtures and more particularly to lighting fixtures that utilize light emitting diodes or LEDs.

SUMMARY

In one embodiment, the invention provides a lighting fixture including a light source including an array of light emitting diodes (LEDs) and a reflector including a input end adjacent the array of LEDs and an output end opposite the input end such that the light source emits light through the reflector from the input end through the output end. The reflector further includes a first, a second, a third, and a fourth sidewall that extend from the input end to the output end. The first and the second sidewalls each including an interior surface, the third and the fourth sidewalls each include an interior surface having a reflectivity that is more diffuse than the interior surfaces of the first and second sidewalls. A lens is adjacent the output end of the reflector.

In another embodiment, the invention provides a lighting fixture including a light source including an array of light emitting diodes (LEDs) and a reflector having a input end adjacent the array of LEDs and an output end opposite the input end such that the light source emits light through the reflector from the input end through the output end. A tandem lens array is adjacent the output end of the reflector.

DETAILED DESCRIPTION

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways.

Figure 14:
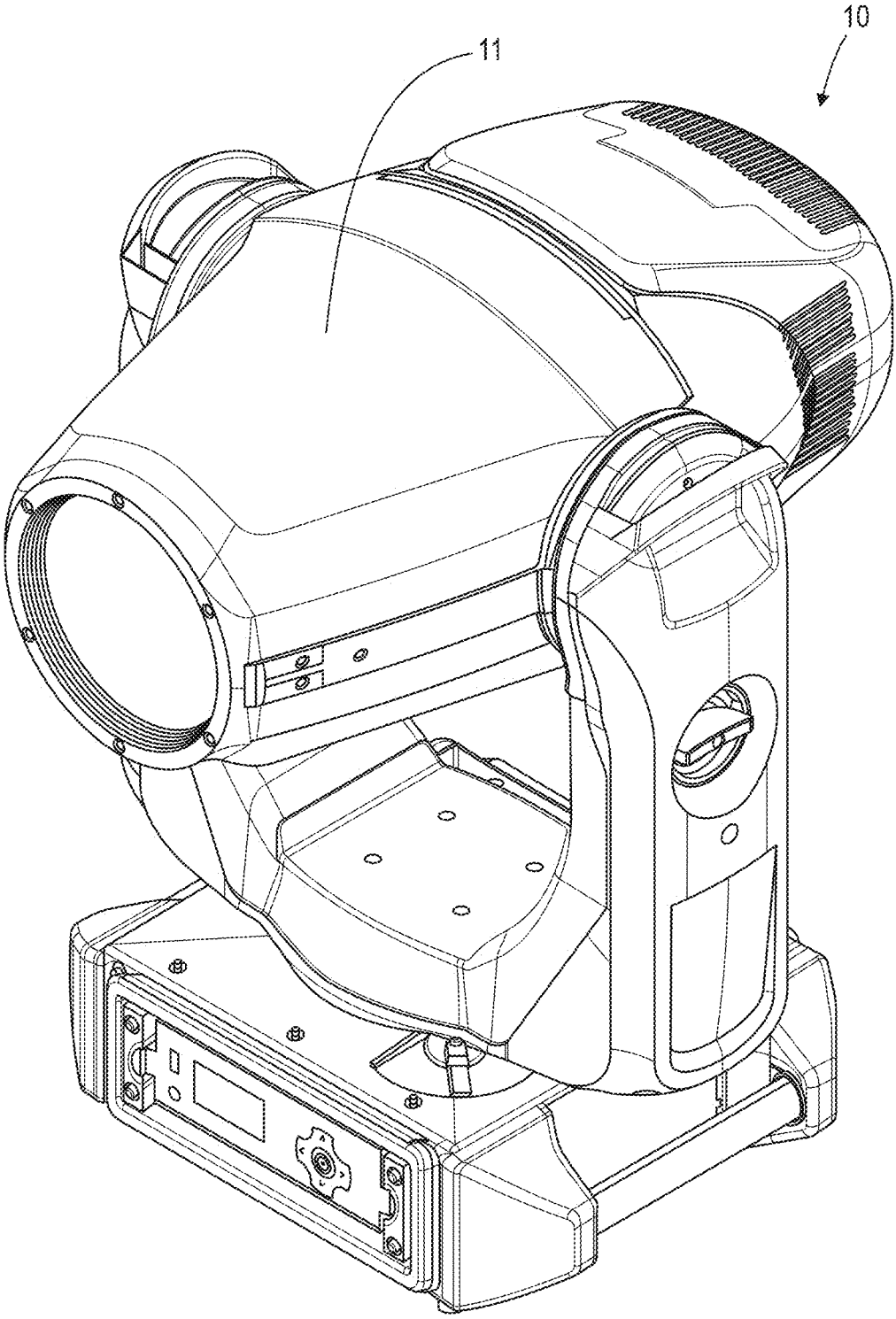
FIG. 14 is a perspective view of a lighting fixture according to an embodiment of the invention.
Figure 15:
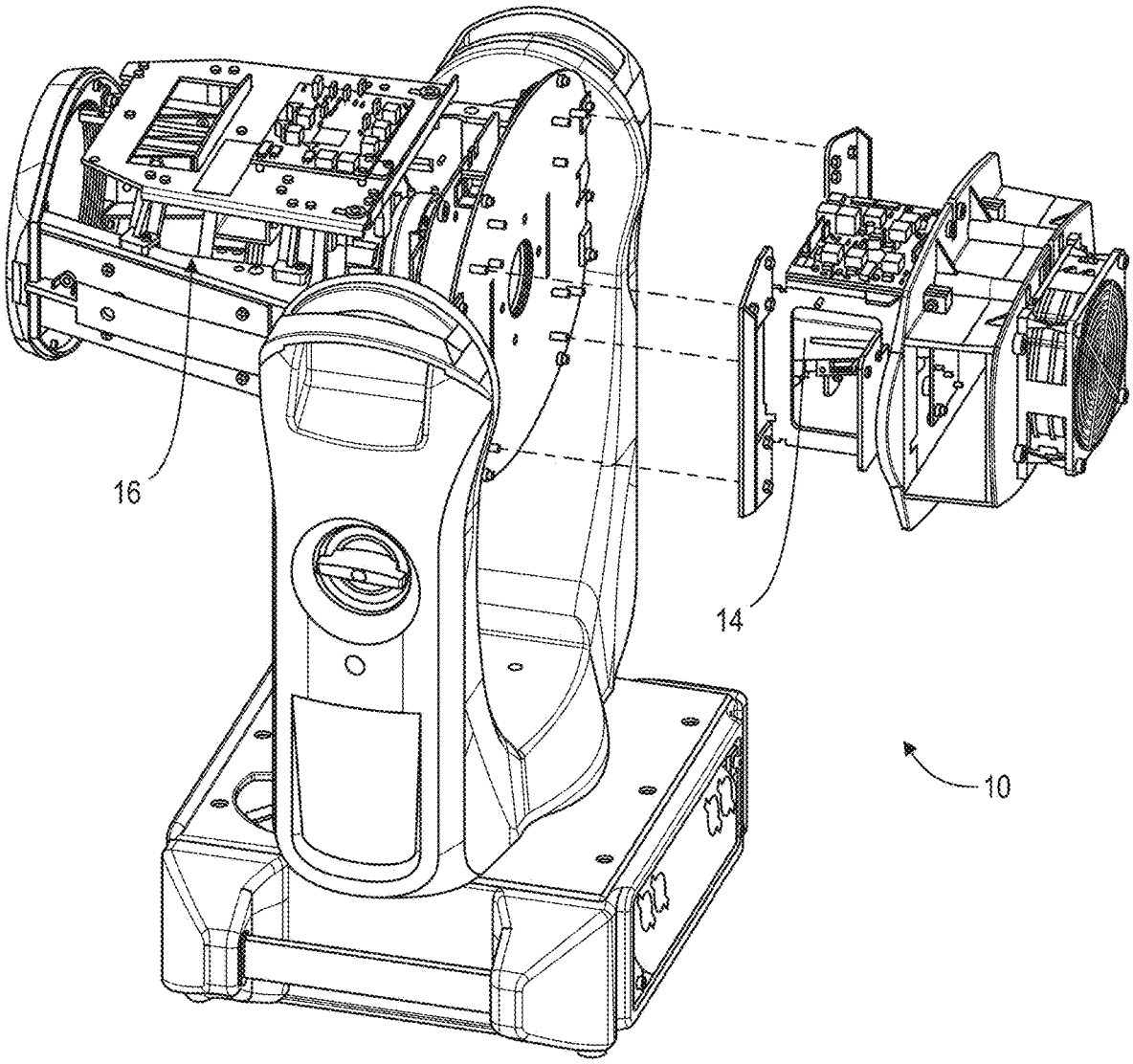
FIG. 15 is a partially exploded view of the lighting fixture of FIG. 14.

FIG. 14 illustrates a lighting fixture or luminaire 10 having a housing 11. Referring to FIGS. 1-4, within the housing 11, the lighting fixture 10 includes a light source 12, a light pipe or reflector 14, and lenses 16. The lighting fixture 10 is particularly suited for use during live performances, including theater productions, concerts, television or movie studio productions, and the like.

Figure 5:
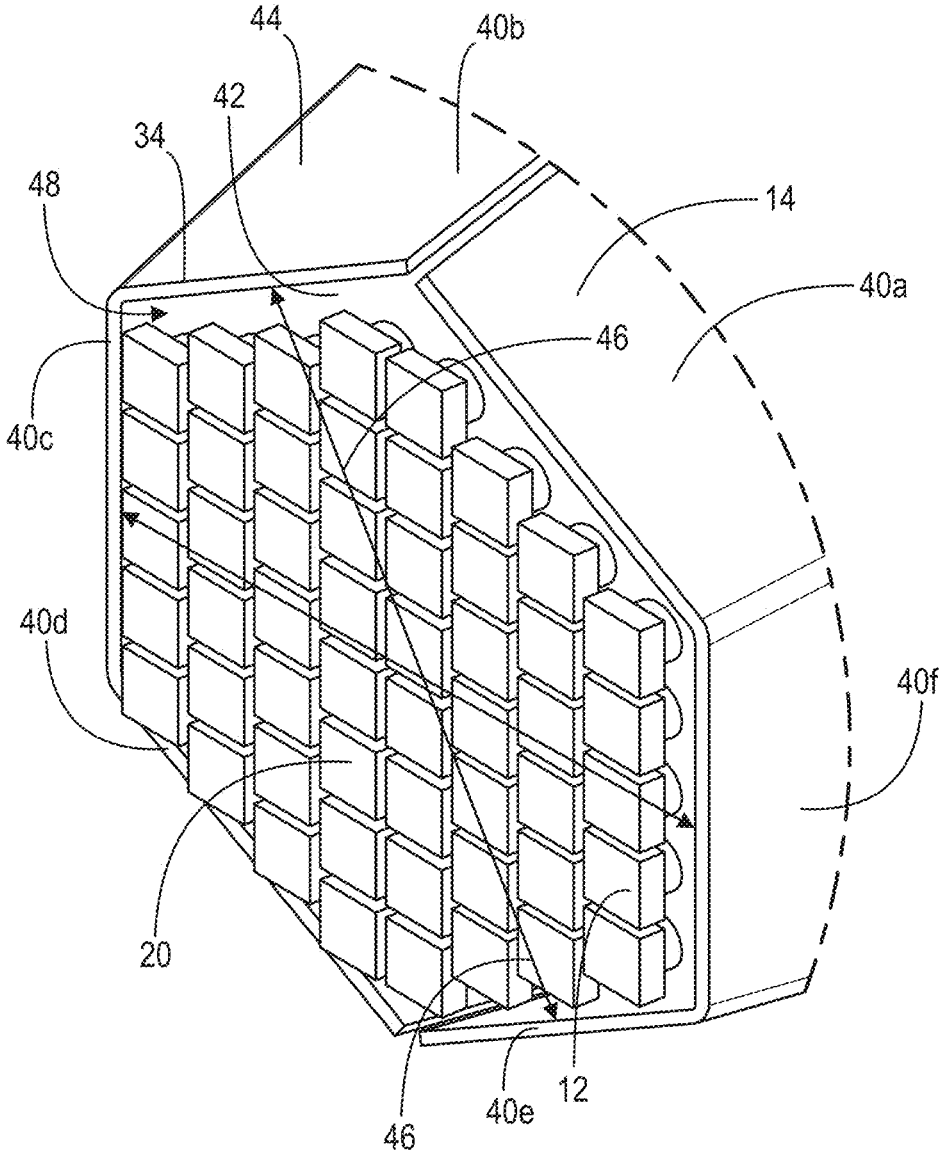
FIG. 5 is a perspective view of an LED array of the lighting fixture of FIG. 1.
Figure 6:
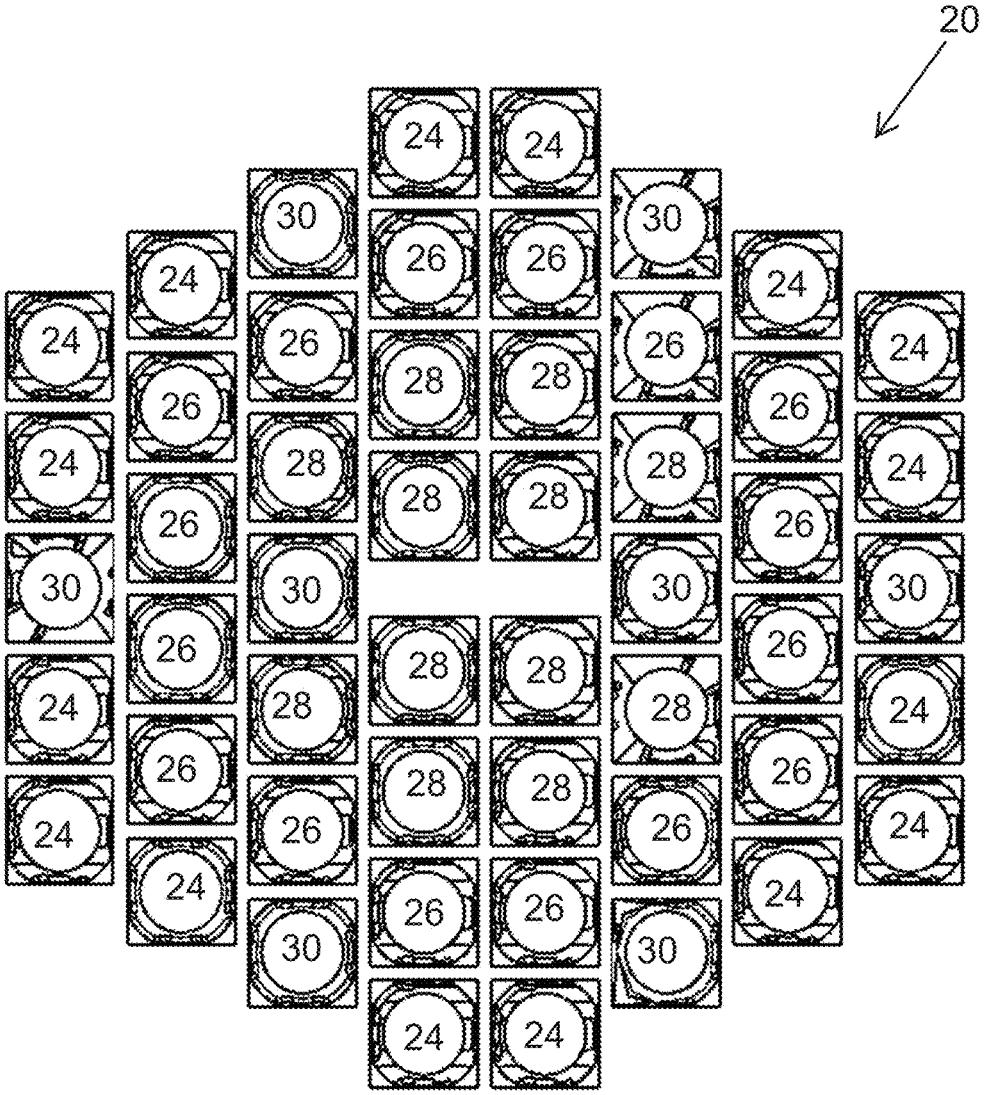
FIG. 6 illustrates an LED color arrangement of the LED array of FIG. 5.

Referring to FIGS. 5 and 6, the light source 12 includes an array 20 of light-emitting diodes (LEDs). In the illustrated embodiment, the array 20 of LEDs is in the shape of a hexagon, which generally matches or corresponds to the cross-sectional shape of the reflector 14. The illustrated array 20 includes 52 individual Luxeon C LEDs spaced closely together producing about 10,000 lumens. The array 20 comprises red 26, lime 24, green 30, and indigo 28 color LEDs. A ring of green 30 and lime 24 LEDs are arranged around the outside perimeter of the array 20. A ring of red LEDs 26 in a hexagon shape is immediately inward from the row of green 30 and lime 24 LEDs. Inside the row of red LEDs 26 are two clusters of indigo LEDs 28 with two green LEDs 30 between the clusters of indigo LEDs 28 inside the row of red LEDS 26. The illustrated array 20 includes 12 indigo LEDs, 8 green LEDs, 16 lime LEDs, and 16 red LEDs in the arrangement illustrated in FIG. 6. In some embodiments, the array 20 includes from 10 to 20 red LEDs, from 10 to 20 lime LEDs, from 5 to 12 green LEDs, and from 8 to 16 indigo LEDs.

The light pipe or reflector 14 includes a first or input end 34 adjacent the array 20 of LEDs and a second or output end 36 opposite the first end 34. The illustrated reflector 14 includes six sidewalls 40*a*-40*f* that extend from the first end 34 to the second end 36. The six sidewalls 40*a*-40*f* are arranged to define the reflector 14 having a hexagonal cross-sectional area. The sidewalls 40*a*-40*f* each include an inwardly facing interior surface 42 and an outwardly facing exterior surface 44. The reflector 14 is tapered such that a distance 46 (see FIG. 5) between the interior surfaces 42 of opposite sidewalls 40*a*-40*f* increases in a direction going from the first end 34 of the reflector 14 to the second end 36. At the first end 34, the distance 46 is the smallest and at the second end 36, the distance 46 is the greatest. In one embodiment, the distance 46 at the second end 36 is in a range from about 3 to about 5 times the distance 46 at the first end 34. It has been found that enhanced collimation of the array 20 is obtained when the distance 46 at the second end 36 is in a range from about 3 to about 5 times the distance 46 at the first end 34.

Figure 7:
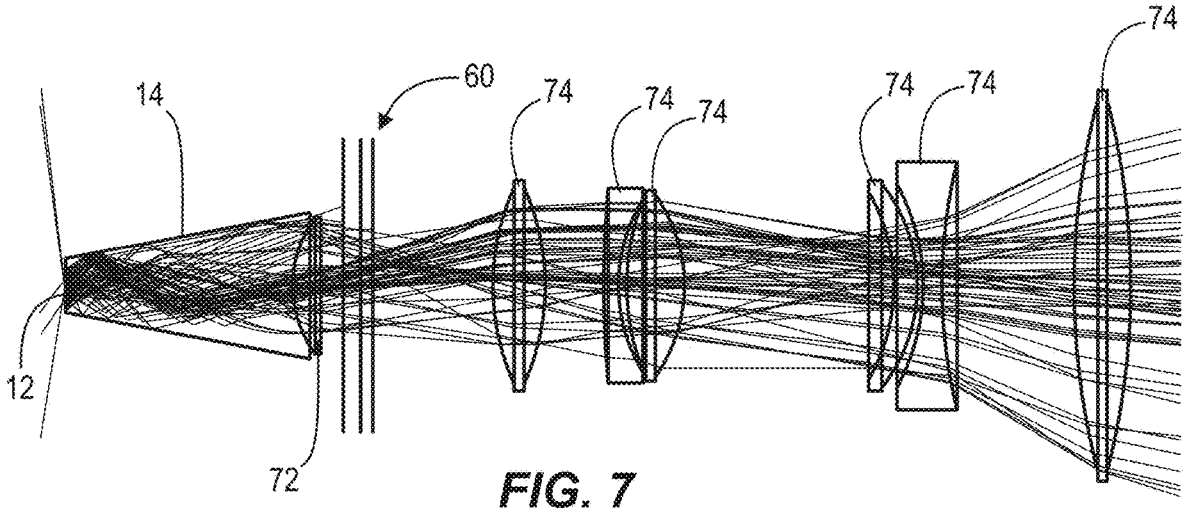
FIG. 7 is an exploded view of the lighting fixture of FIG. 1 illustrating color mixing and collimation of the LED array of FIG. 5.

At the first end 34, the distance 46 is about the same as a corresponding width of the array 20 of LEDs to minimize any gap 48 (FIG. 5) between the array 20 and the sidewalls 40*a*-40*f*. The reflector 14 is tapered, which collimates light bouncing off the sidewalls 40*a*-40*f* from the array 20 of LEDs as shown in FIG. 7. In the embodiment illustrated in FIGS. 1-7, the taper of the sidewalls 40*a*-40*f* is straight or linear between the first end 34 and the second end 36. Referring to FIG. 3, a longitudinal axis 50 of the reflector 14 is defined as an axis that extends centrally through the first end 34 and the second end 36 of the reflector 14. The sidewalls 40*a*-40*f* are tapered at an angle 52 (FIG. 4) relative to the axis 50. In one embodiment, the angle 52 is in a range from about 10 degrees to about 20 degrees. It has been found that enhanced collimation of the array 20 is obtained when the angle 52 is in a range from about 10 degrees to about 20 degrees.

With continued reference to FIG. 3, a length 54 of the reflector is defined as the distance from the first end 34 to the second end 36 measured along the axis 50. In one embodiment, the length 54 is about 7.5 times the distance 46 at the first end 34 and the distance 46 at the second end 36 is about 4 to 5 times the distance 46 at the first end 34 with the angle 53 of the sidewalls 40*a*-40*f* in a range from about 8 to about 14 degrees. It has been found that the reflector 14 with these relative dimensions provides good collimation of the array 20.

Figure 8:
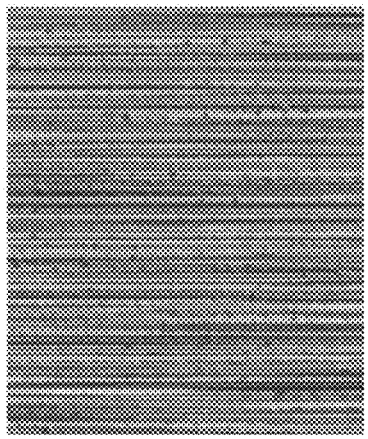
FIG. 8 illustrates a surface finish of a reflector of the lighting fixture of FIG. 1.

FIGS. 8-10C illustrate surface feature configurations of the interior surfaces 42 of the sidewalls 40*a*-40*f* of the reflector 14. In one embodiment, some of the sidewalls 40*a*-40*f* have an interior surface 42 that is specular while some of the sidewalls 40*a*-40*f* have an interior surface 42 that includes a diffusing structure. The diffusing structure aids in color mixing. For example, FIG. 8 illustrates an example of such a diffusing structure on an aluminum surface having a grain, and called a mill finish. The diffusing grain extends or is aligned along the longitudinal axis 50 of the reflector 14. Aligning the grain parallel to the longitudinal axis 50 causes a variation in the azimuthal angle of light reflected from the surface. This improves color mixing while minimizing lumen loss caused by the diffusion. In other embodiments, other types of diffusing structures can be utilized on the interior surfaces 42 of the sidewalls 40*a*-40*f*, including other types of milled or embossed structures. In one embodiment, the diffusing structures have a diffuse reflection value in a range from about 80% to about 90%. The specular interior surfaces 42 of some of the sidewalls 40*a*-40*f* can be made from silver coated aluminum. In other embodiments, other suitable materials can be used, including glass, plastic, and/or other types of aluminum.

Figure 10A:
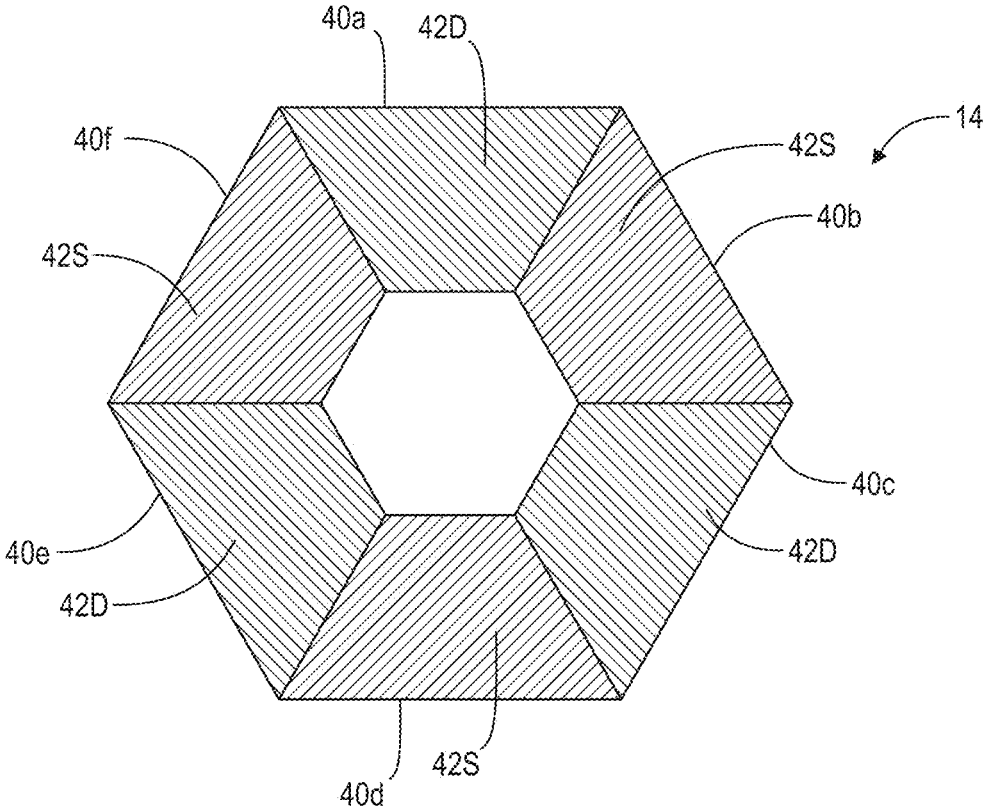
FIGS. 10A-10C illustrate possible arrangements of surface finishes of the reflector of the lighting fixture of FIG. 1.
Figure 10B:
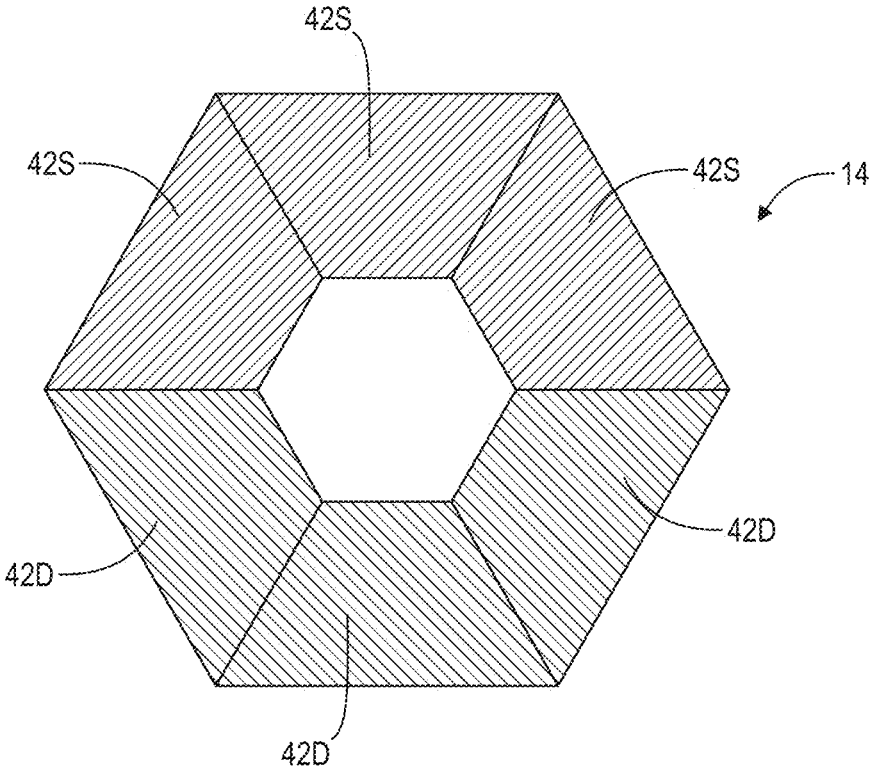
Figure 10C:
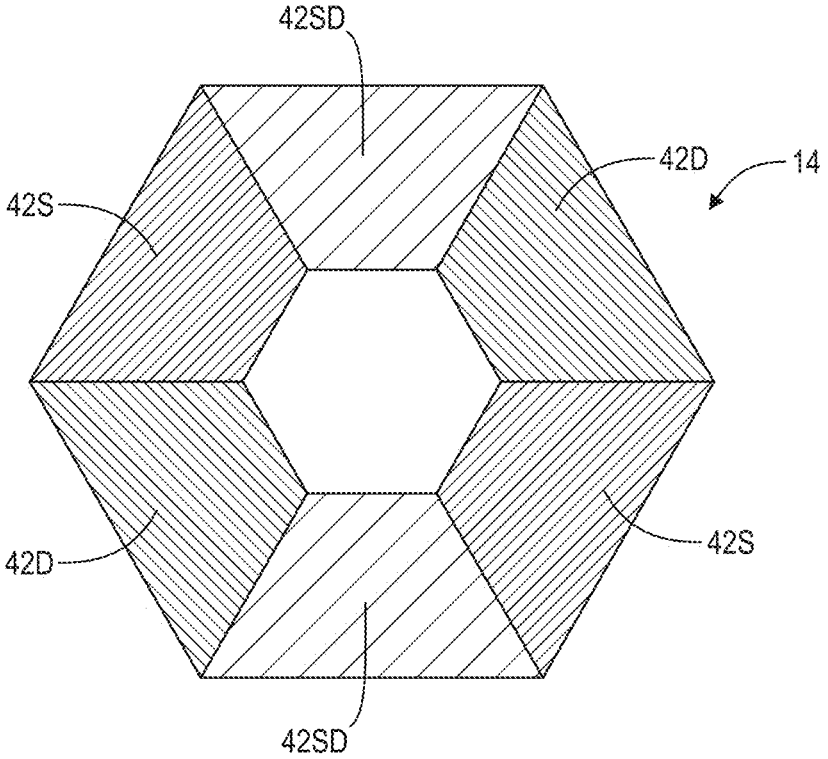

In one embodiment, half of the sidewalls 40*a*-40*f* include an interior surface 42 with a diffusing structure and half of the sidewalls 40*a*-40*f* include an interior surface 42 that is specular. This arrangement has been found to provide good color mixing of the array 20 with reduced lumen loss. FIG. 10A-10C illustrate possible configurations of the interior surfaces 42. In the embodiment of FIG. 10A and 10B, the interior surfaces 42S include specular interior surfaces 42 and the interior surfaces 42D including interior surfaces 42 with a diffusing structure.

The interior surfaces 42D with a diffusing structure, which may be the same or a different diffusing structure, have a reflectivity that is more diffuse than the specular interior surfaces 42S. In the embodiment of FIG. 10A, the specular interior surfaces 42S alternate with diffusing interior surfaces 42D. In the embodiment of FIG. 10B, one side of the reflector 14 includes specular interior surfaces 42S while the opposite side includes diffusing interior surfaces 42D. The reflector 14 in the embodiment of FIG. 10C includes interior surfaces with three different finishes; specular interior surfaces 42S, diffusing interior surfaces 42D, and interior surfaces 42SD with a different interior surface finish. For example, diffusing interior surfaces 42D have a reflectivity that is most diffuse, specular interior surfaces 42S have a reflectivity that is least diffuse, and the interior surfaces 42SD have a reflectivity with a diffuseness that is between 42D and 42S.

Figure 9:
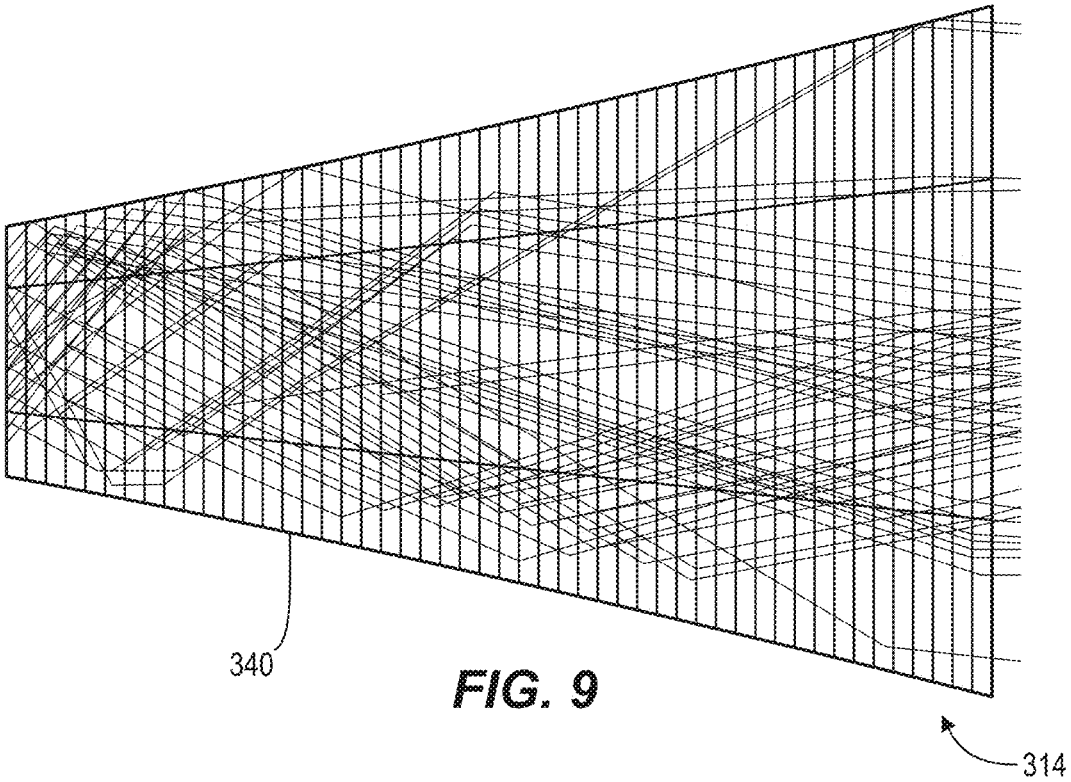
FIG. 9 illustrates a reflector according to another embodiment of the invention.
Figure 11:
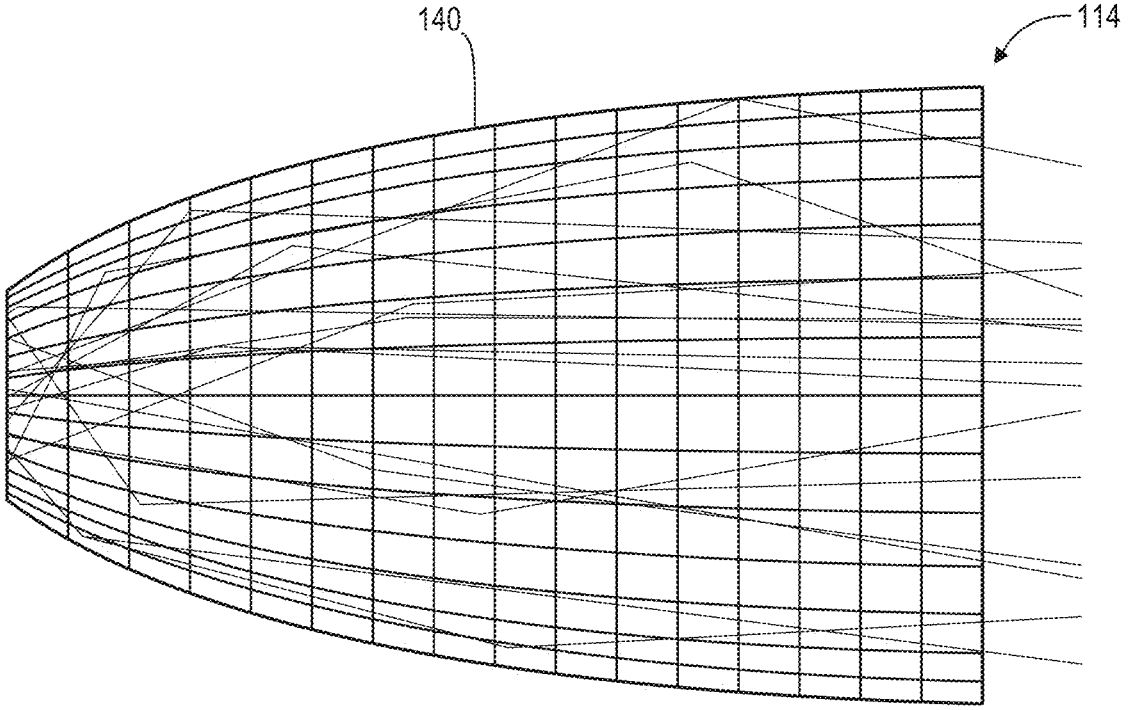
FIG. 11 illustrates a reflector according to another embodiment of the invention.
Figure 12:
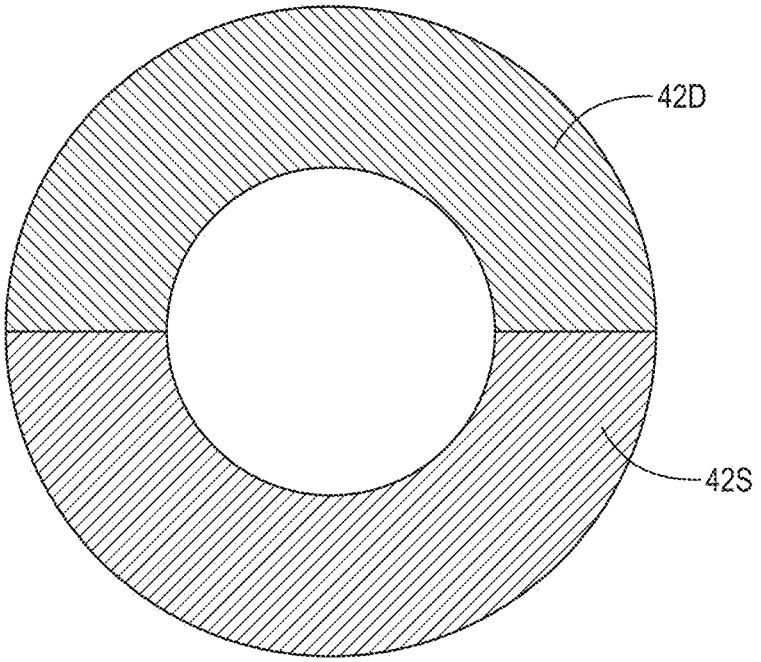
FIG. 12 illustrates a possible arrangement of surface finishes of the reflector of FIG. 11.
Figure 22:
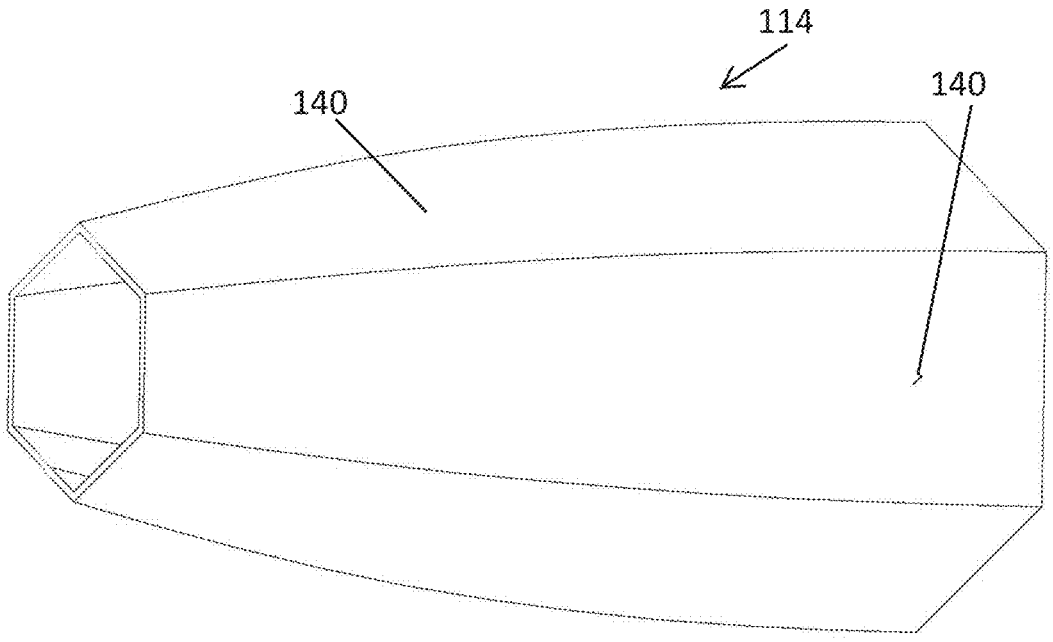
FIG. 22 is a perspective view of a reflector according to another embodiment.
Figure 23:
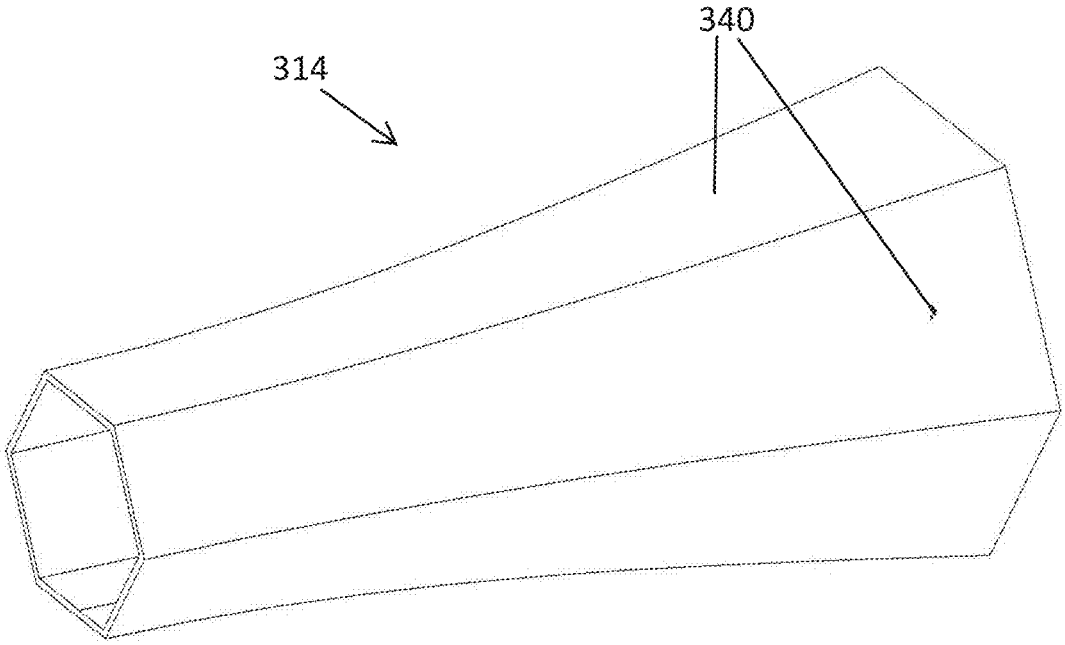
FIG. 23 is a perspective view of a reflector according to another embodiment.

FIGS. 11 and 22 illustrate a reflector 114 according to another embodiment that may be used with the lighting fixture 10 in place of the reflector 14. The reflector 114 has sidewalls 140 that are curved and parabolic in the illustrated embodiment. FIGS. 9 and 23 illustrate a reflector 314 according to yet another embodiment. The reflector 314 is generally trumpet shaped with sidewalls 340 that are curved and parabolic in the illustrated embodiment. Also, the cross-sectional shape of the reflectors 114, 314 can be circular, elliptical, or a polygon. The reflectors 114, 314 can also include portions of the interior surface(s) of the sidewall(s) 140, 340 with some surfaces that are specular and some surfaces that include a diffusing structure. FIG. 12 illustrates a possible interior surface configuration for the reflectors 114, 314 of FIGS. 9 and 11. As represented by FIG. 12, about one half of the sidewalls 140, 340 include the specular interior surface 42S while the other half of the sidewalls 140, 340 includes the diffusing interior surface 42D.

Figure 13A:
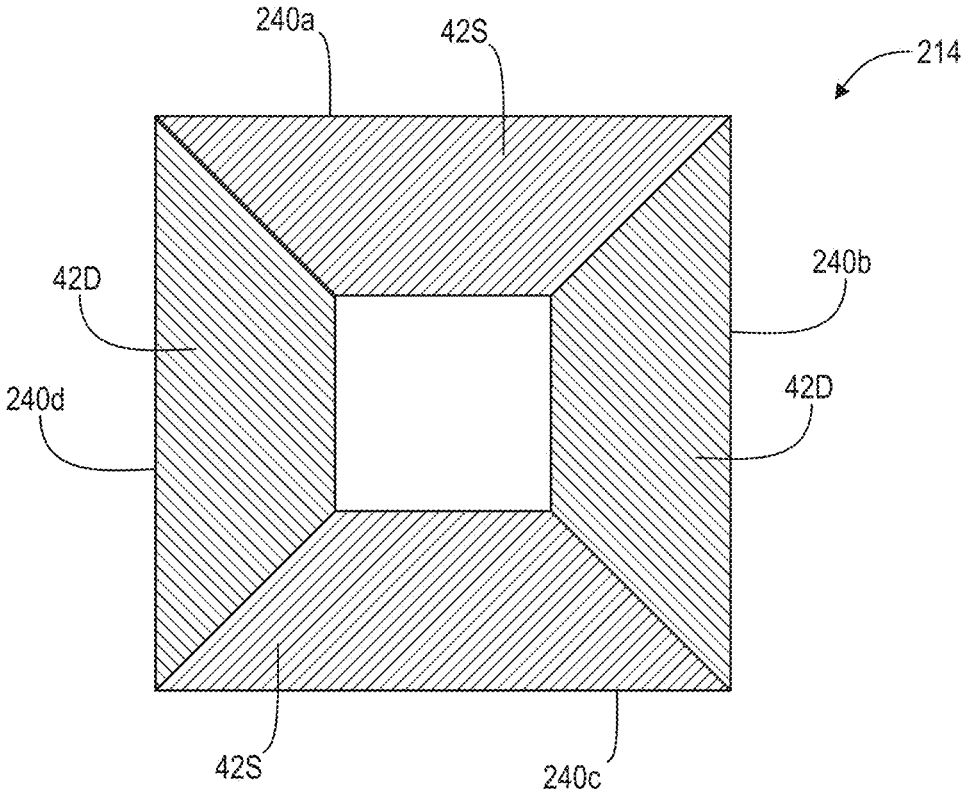
FIGS. 13A and 13B illustrate possible arrangements of surfaces finishes of a reflector according to another embodiment of the invention.
Figure 13B:
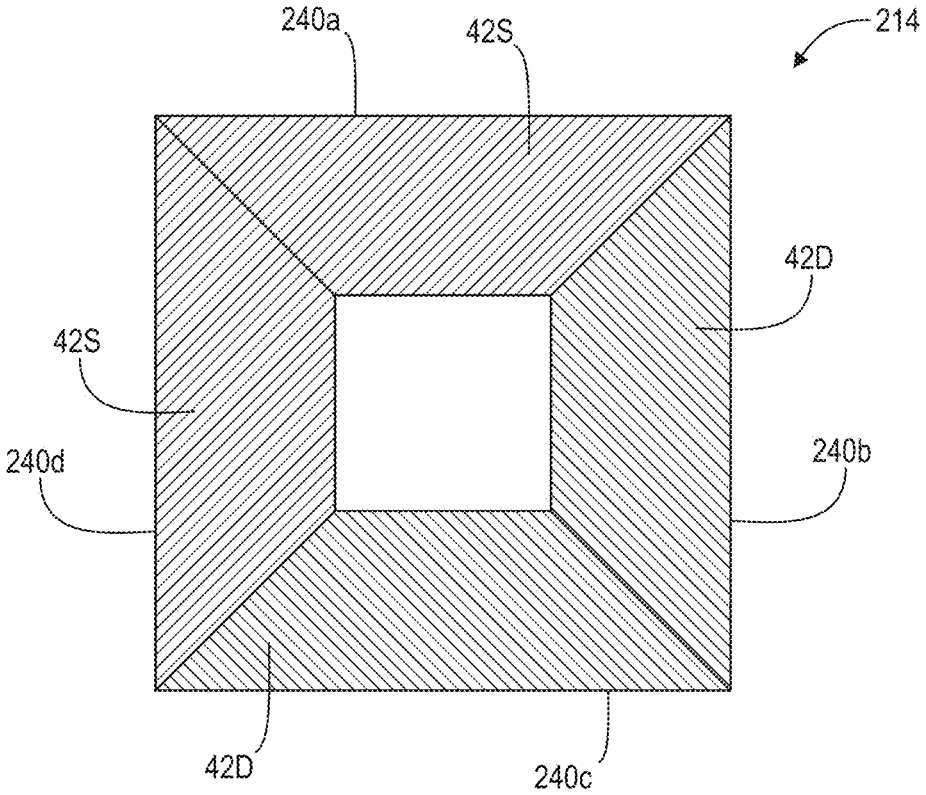

Although the reflectors 14, 114, and 314 of FIGS. 10A-10C include six sidewalls 40*a*-40*f*, in other embodiments the reflector may have more than six sidewalls or less than six sidewalls. For example, FIGS. 13A-13B illustrate a reflector 214 that includes four sidewalls 240*a*-240*d*. In the embodiment of FIG. 13A, the sidewalls 240*b* and 240*d* have interior surfaces 42D that include a diffusing structure and the sidewalls 240*a* and 240*c* have interior surfaces 42S that include a specular surface. In the embodiment of FIG. 13B, the adjacent sidewalls 240*a* and 240*d* on one side of the reflector 214 include interior surfaces 42S that include a specular surface and the adjacent sidewalls 240*b* and 240*c* on the opposite side include interior surfaces 42D that include the diffusing structure.

Figure 1:
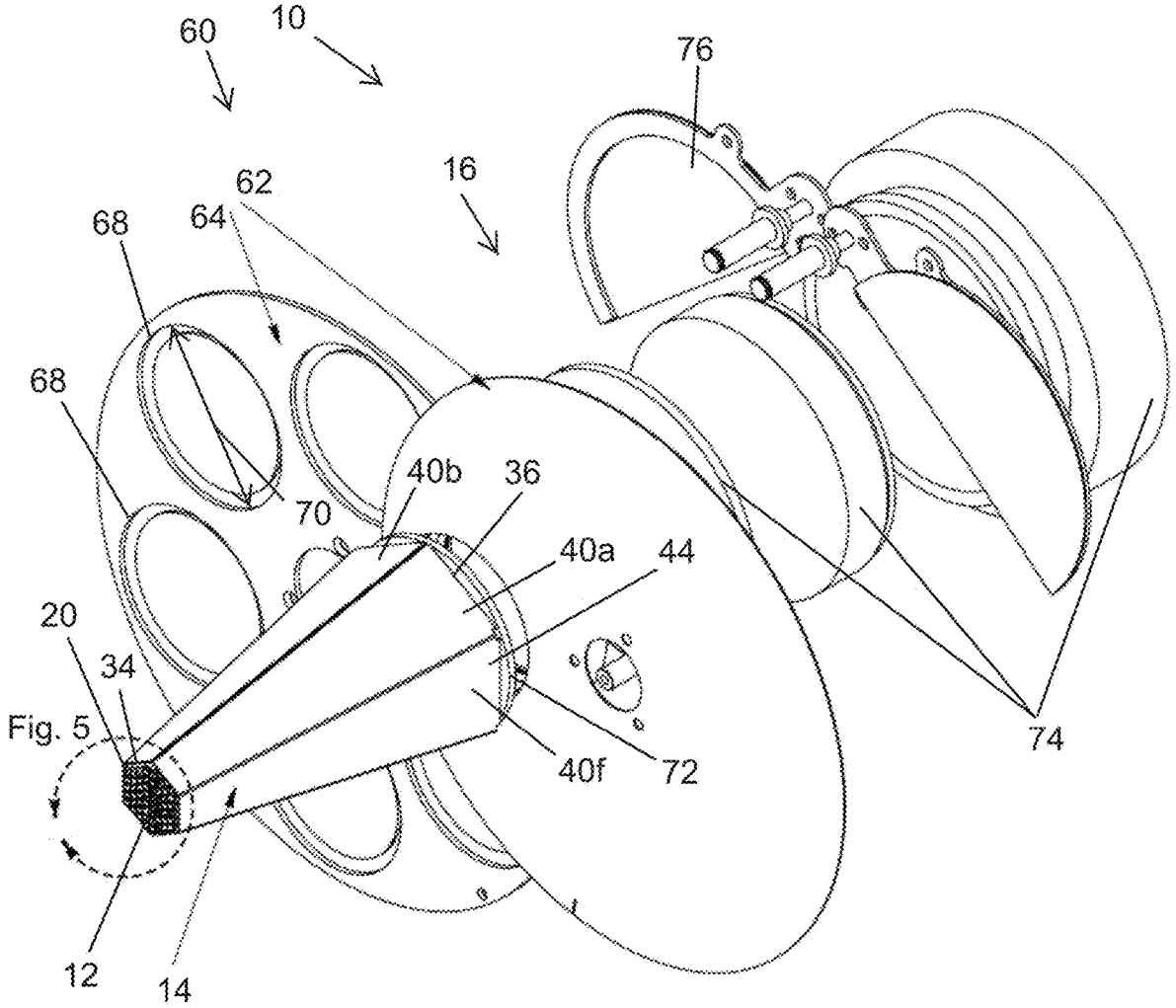
FIG. 1 is an exploded view of a portion of the lighting fixture of FIG. 14.

Referring to FIG. 1, in some embodiments, the sidewalls 40*a*-40*f* can be constructed from folded metal or from individual metal pieces that are tabbed, welded, or fixed with adhesive to the inside of a ridged housing to form the reflector 14. In other embodiments, the reflector 14 could also be made from glass or plastic with portions of the reflector having a molded pattern or a finish created by sand-blasting or etching.

Figure 2:
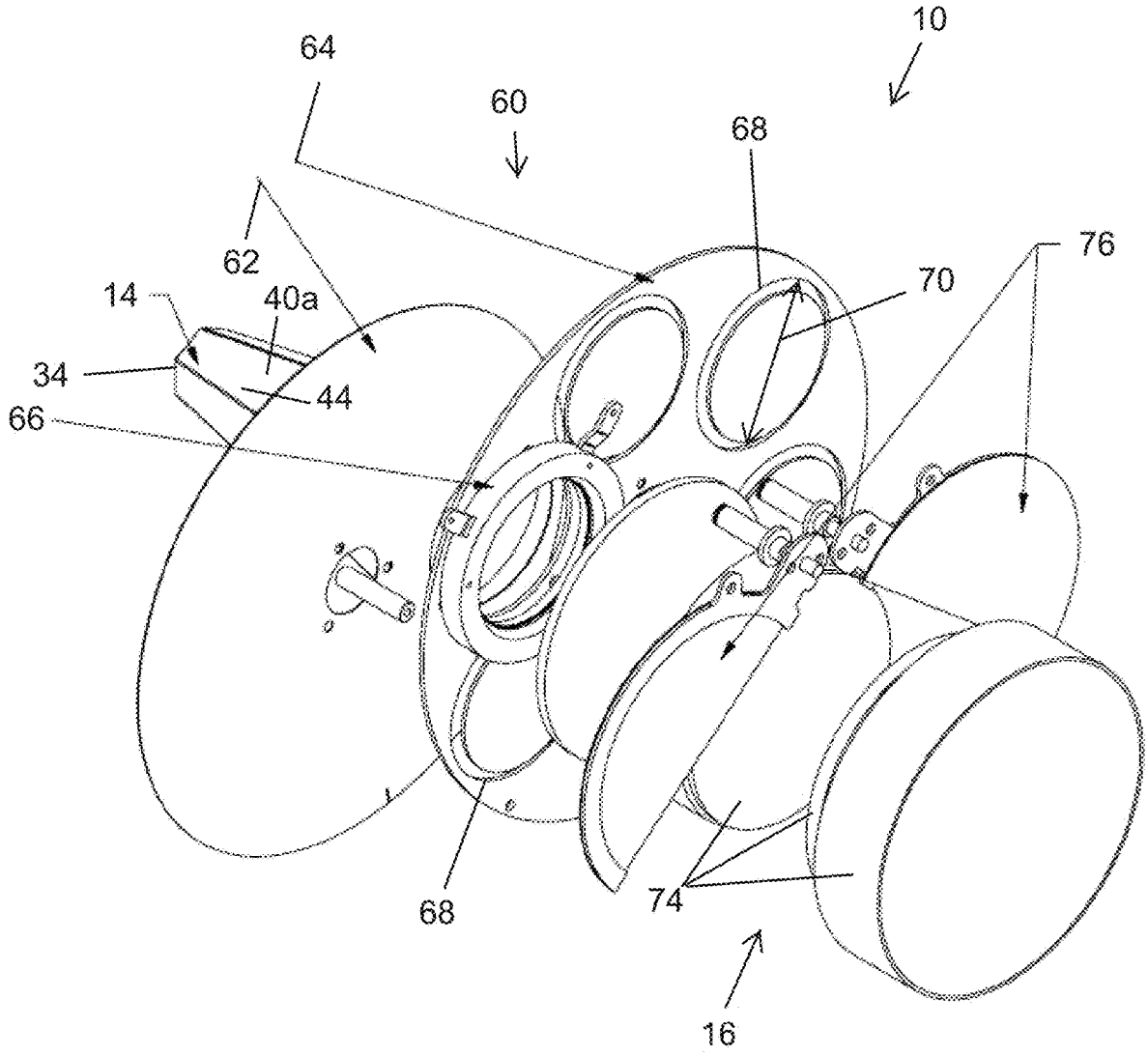
FIG. 2 is an alternative exploded view of the lighting fixture of FIG. 1.
Figure 3:
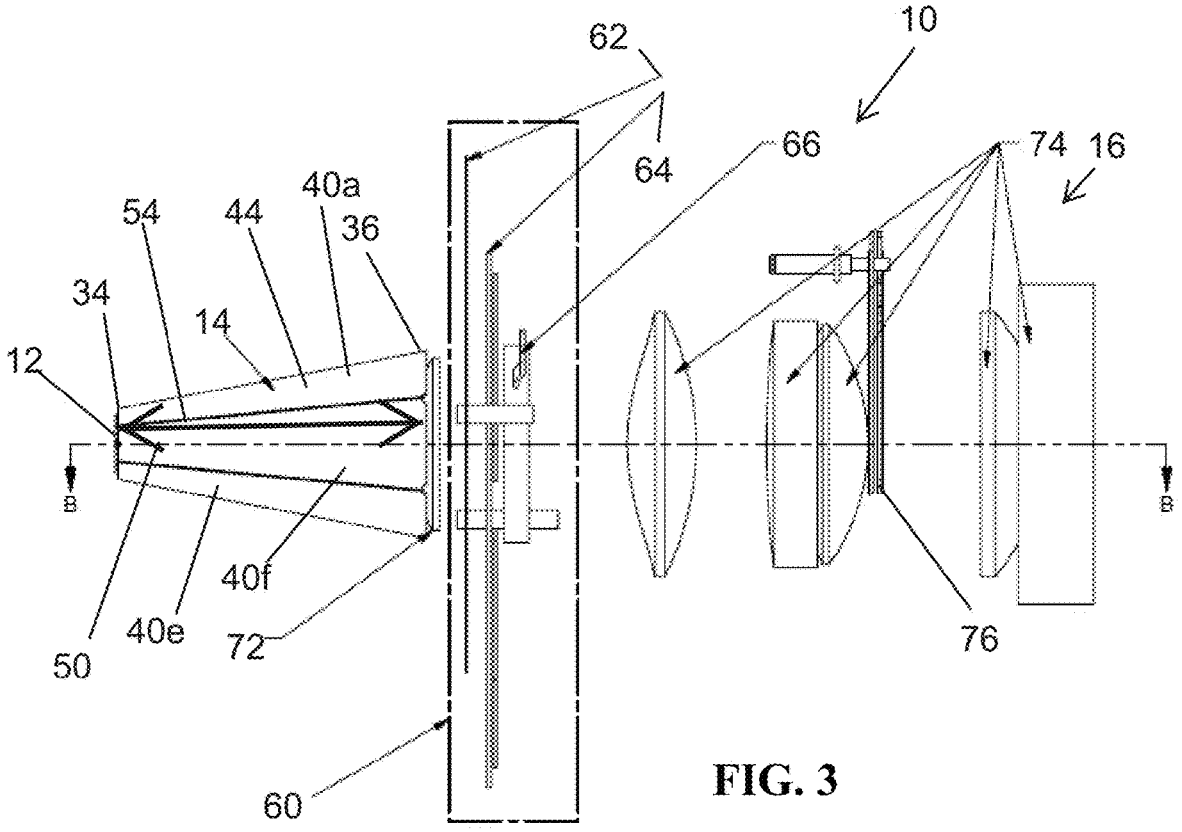
FIG. 3 is an alternative exploded view of the lighting fixture of FIG. 1.

Referring to FIG. 2, the lighting fixture further includes an effects module 60. The illustrated effects module 60 includes a first gobo wheel 62, a second gobo wheel 64, and an iris 66. The gobo wheel 64 includes gates 68 that each have a diameter or inner dimension 70. In one embodiment, design for the dimension of the reflector 14 starts with the gate dimension 70. In one embodiment, the distance 46 at the second end 36 of the reflector 14 is in a range from about 1.3 to about 1.4 times the gate dimension 70. Then, as discussed in the example above, the length 54 of the reflector 14 is about 7.5 times the distance 46 at the first end 34 and the distance 46 at the second end 36 is about 4 to 5 times the distance 46 at the first end 34 with the angle 53 of the sidewalls 40*a*-40*f* in a range from about 8 to about 14 degrees. These dimensions provide good color mixing of the array 20.

Figure 4:
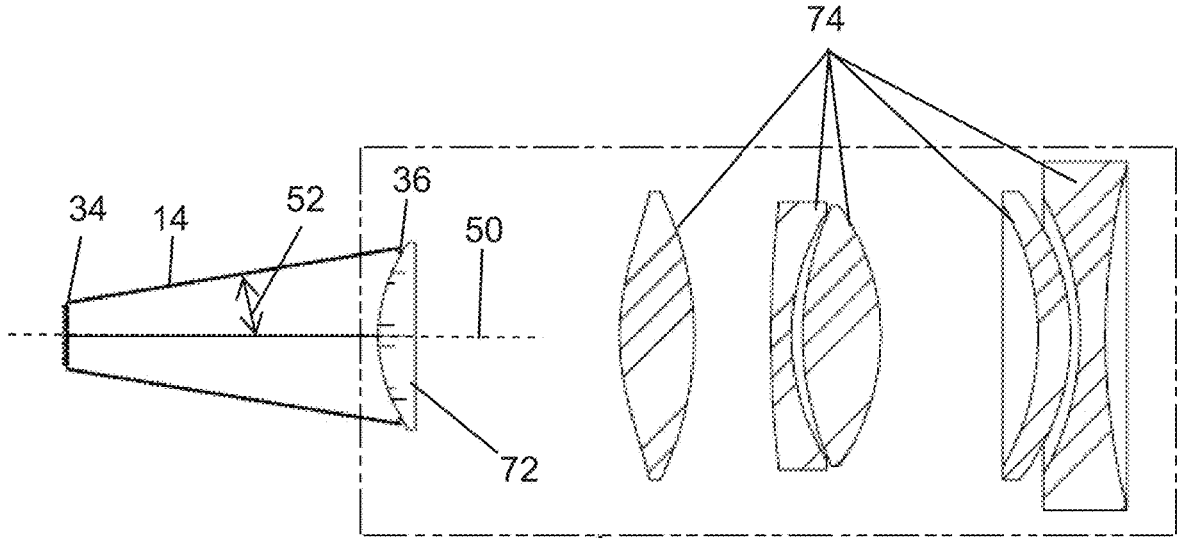
FIG. 4 is a cross-sectional exploded view of the lighting fixture of FIG. 3 taking along line B-B in FIG. 3.

Referring to FIGS. 3-4, the lenses 16 include a field lens 72 and zoom projection lenses 74. In one embodiment, the zoom projection lenses 74 provide an achromatic design with a 3:1 zoom. The zoom projection lenses 74 project the gobo or iris onto a wall or screen. The field lens 72 adjusts the angle of the light received from the reflector 14 and the light source 12 to match the gates 68 and zoom optics 74. The illustrated lighting fixture 10 also includes diffusion media 76 that can pivot into and out of the light path to diffuse light from the lighting fixture 10.

Figure 16:
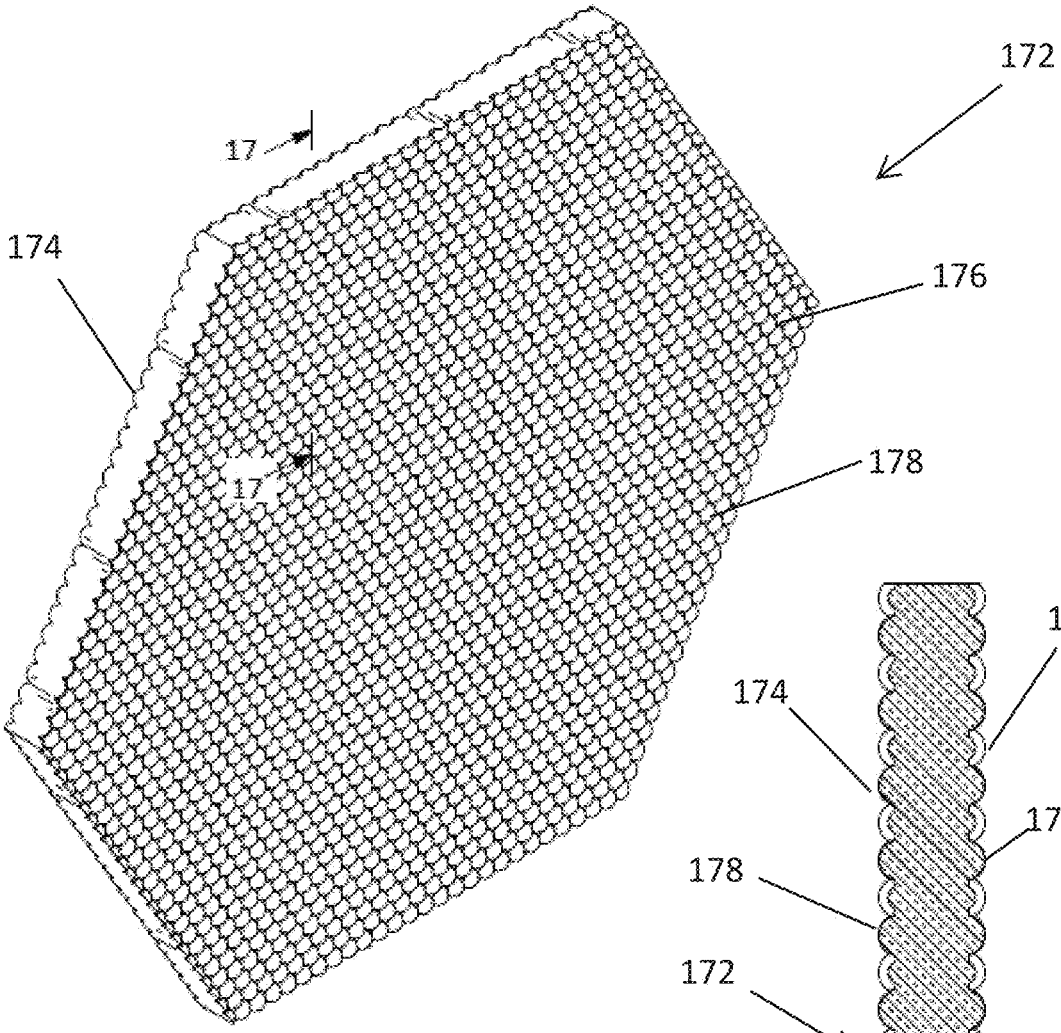
FIG. 16 is a perspective view of a tandem lens array according to one embodiment.
Figure 17:
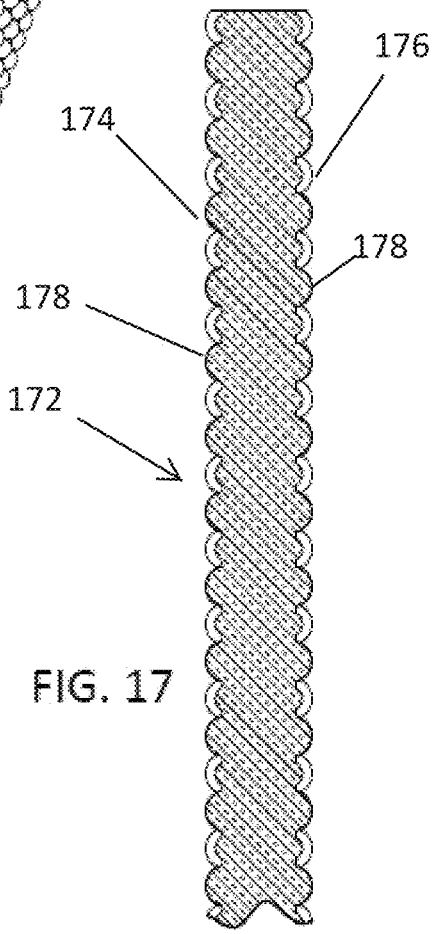
FIG. 17 is a cross-sectional view of the lens of FIG. 16 taken along lines 17-17 of FIG. 16.

FIGS. 16 and 17 illustrate a lens 172, which is a tandem lens array that can be used in a light fixture according to another embodiment. The tandem lens array 172 is hexagonal and can be positioned adjacent or within the second end 36 of the hexagonal reflector 14 in place of the lens 72 of FIG. 4. In such an embodiment, the light fixture may not include the zoom projection lenses 74. Rather, the light fixture can include a Fresnel lens moveable along the longitudinal axis 50 to alter the beam angle of the light beam from the lighting fixture. In other embodiments, the tandem lens array 172 may have other suitable shapes to match the shape of the second end of the reflector. Generally, all of the light emitted from the reflector 14 passes through the tandem lens array 172. In one embodiment of the light fixture including the tandem lens array 174, the reflector 14 does not include the interior sidewalls with a diffusing structure described above. Rather, all of the interior surfaces of the reflector are highly specular because color mixing is enhanced by the tandem lens array 172. The tandem lens array 172 is particularly suited for use in a wash beam type light fixture.

The tandem lens array 172 is a single substrate in one embodiment that includes a first side 174 that faces toward the array 20 of LEDs and a second side 176 that is opposite the first side 172. The first side 174 includes an array of approximately semi-sphere shaped lenses 178 arranged in a repeating pattern. The second side 176 includes the same array of approximately semi-sphere shaped lenses 178. The lenses 178 are approximately semi-sphere shaped because the lenses 178 have an F-number that is about 1.159 in the illustrated embodiment. An F-number of 1.0 would correspond to lenses that are an exact or precise semi-sphere shape. In other embodiments, the pattern of lenses may be randomized rather than repeating. The tandem lens array 172 breaks up the light after it has been mixed and collimated in the reflector 14 into multiple overlapping beams, or Kohler illuminators, which further mixes the light to a better uniformity.

Figure 18:
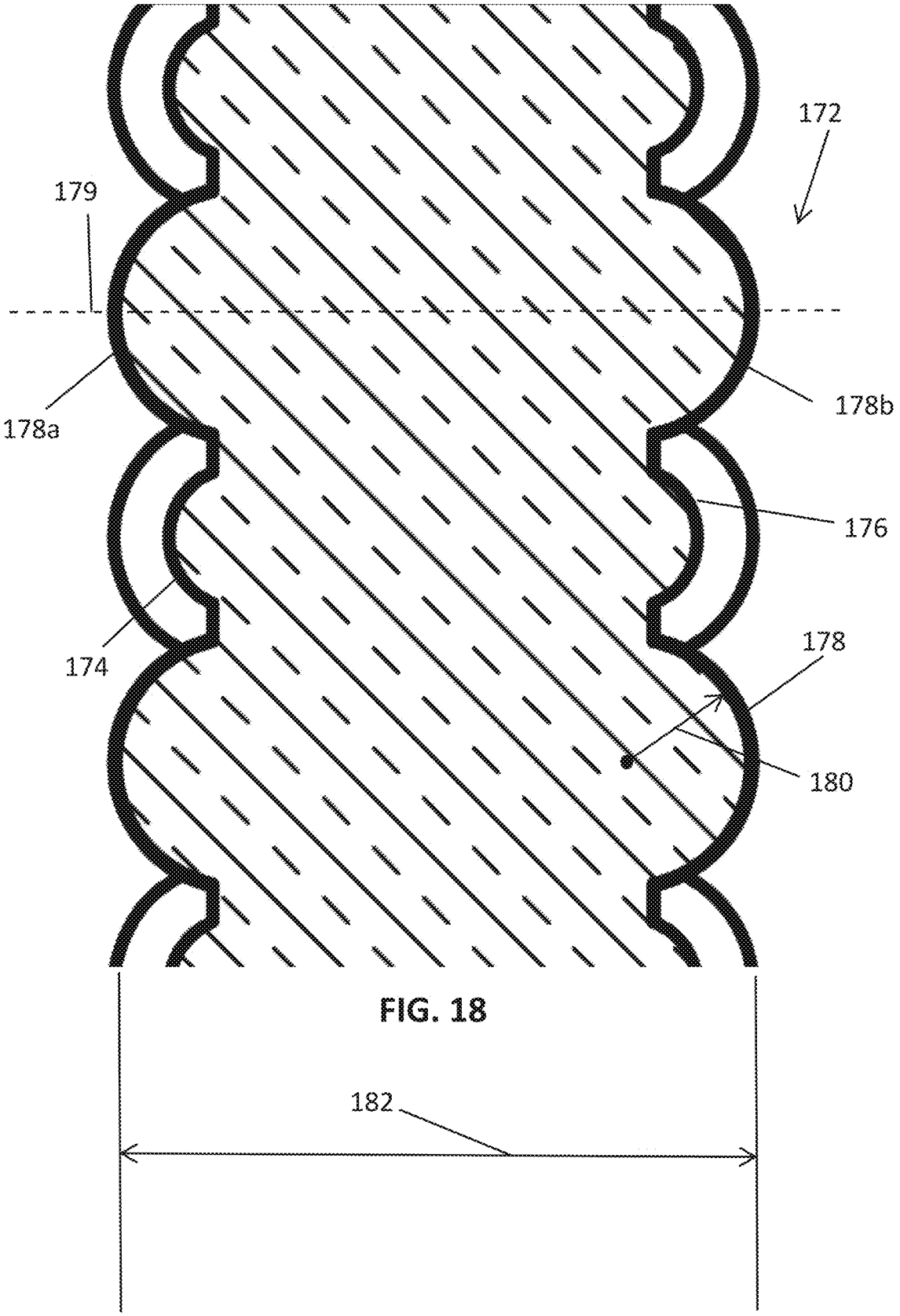
FIG. 18 is an enlarged portion of FIG. 17.

Referring to FIG. 18, in the illustrated embodiment, the lenses 178 on the first side 174 have corresponding lenses 178 (or matching pair) on the second side 176 with a common axis 179 that extends centrally through the corresponding lenses 178. A lens pair 178*a* and 178*b* from sides 174, 176 are labeled in FIG. 18 having the common axis 179. In one embodiment, the lenses 178 having a radius of curvature 180 (FIG. 18) that is about 1.6 mm and the lens 172 has a thickness 182 measured from the first side 174 to the second side 176 that is about 5 mm. In such an embodiment, the numerical aperture of the pair of lenses 178*a*, 178*b* is about 0.43 with an F-number that is about 1.159. The tandem lens array 172 can be used in a light fixture having about 44 multicolor LEDs with an array maximum diameter 46 (FIG. 5) that is about 19.5 mm. The light fixture can also include a hexagonal reflector 14 with a maximum diameter at the input end 34 that is about 21 mm. It has been found that in the example lens 172 and light fixture described in this paragraph, a reflector 14 with a taper angle 52 (FIG. 4) between about 5 degrees and 20 degrees is preferred for adequate color mixing of the multi-color LEDs. A reflector length (i.e., distance from input end 34 to output end 36 (FIG. 4)) indicated in the chart below has been found to be preferred for each of the indicated angles 52 to provide the maximal possible optical efficiency, about 80 percent or more. The reflector length for all angles 52 listed can be significantly shorter if slightly lower efficiencies (e.g., from about 60 percent to about 75 percent) are acceptable. For example, if 60 percent optical efficiency is desired or acceptable, at 5 degrees the length is about 150 mm, at 10 degrees the length is about 75 mm, at 15 degrees the length is about 65 mm, at 20 degrees the length is about 50 mm. The reflector length and angle 52 then provide the maximum diameter of the output 36 shown in the chart. The tandem lens array 172 has been found to reduce the length of the reflector needed for adequate color mixing of the multi-color LEDs.

| Angle 52 (degrees) | Length of Reflector (mm) | Max Diameter OutputEnd 36 (mm) |
|---|---|---|
| 5 | 200 | 56 |
| 10 | 150 | 74 |
| 15 | 110 | 80 |
| 20 | 95 | 90 |

Figure 19:
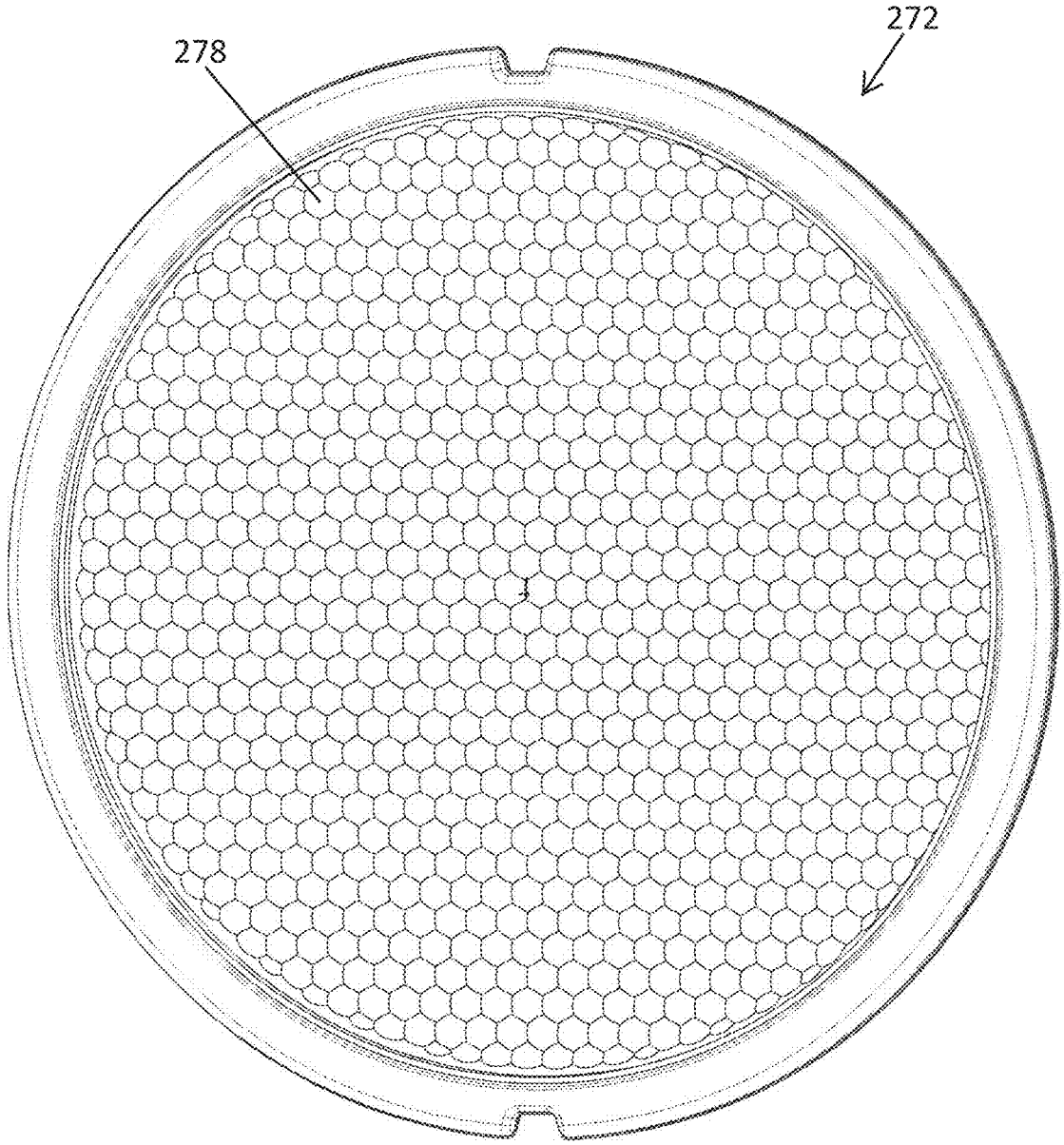
FIG. 19 is a perspective view of a tandem lens array according to another embodiment.
Figure 20:
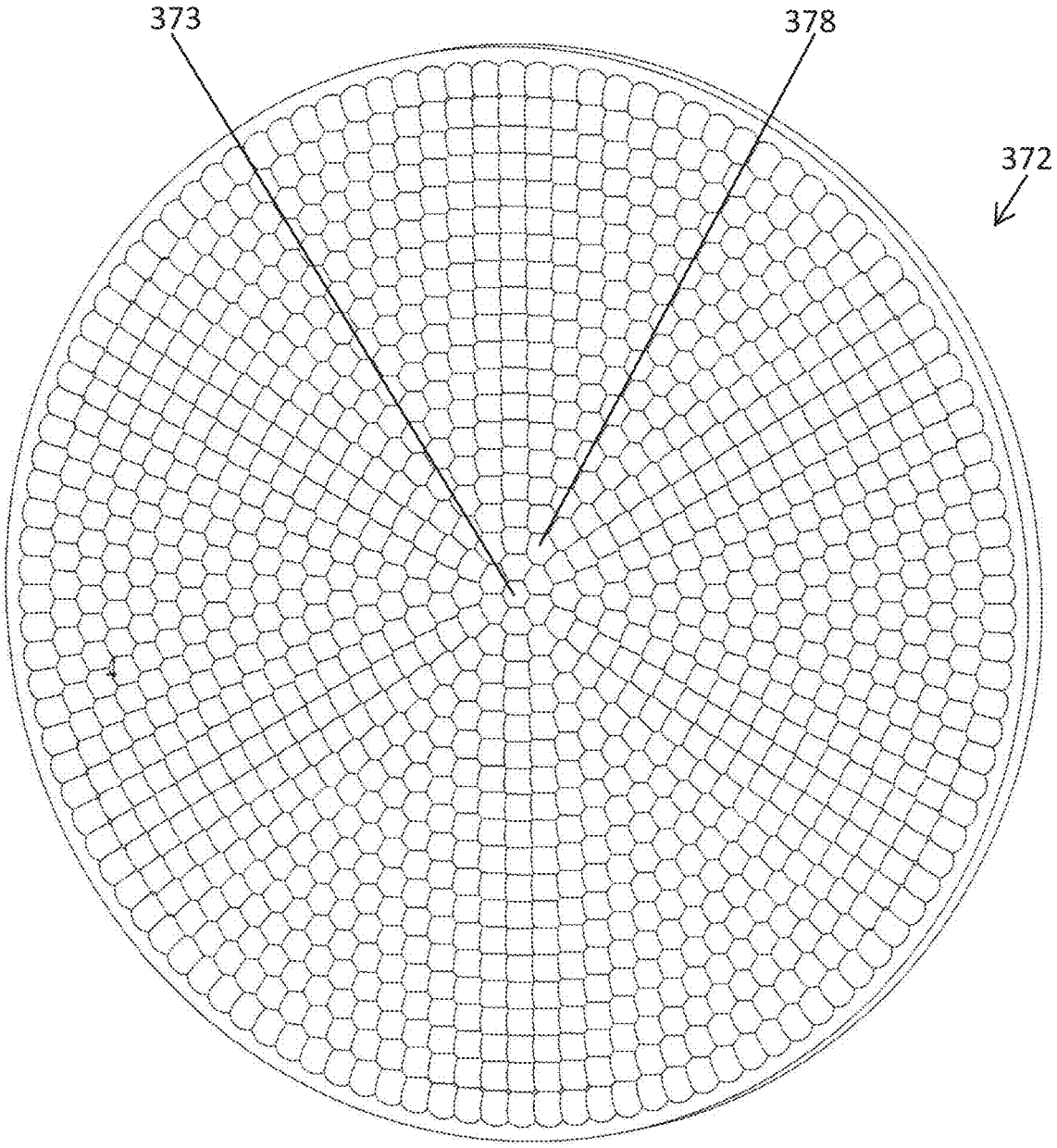
FIG. 20 is a perspective view of a tandem lens array according to another embodiment.
Figure 21:
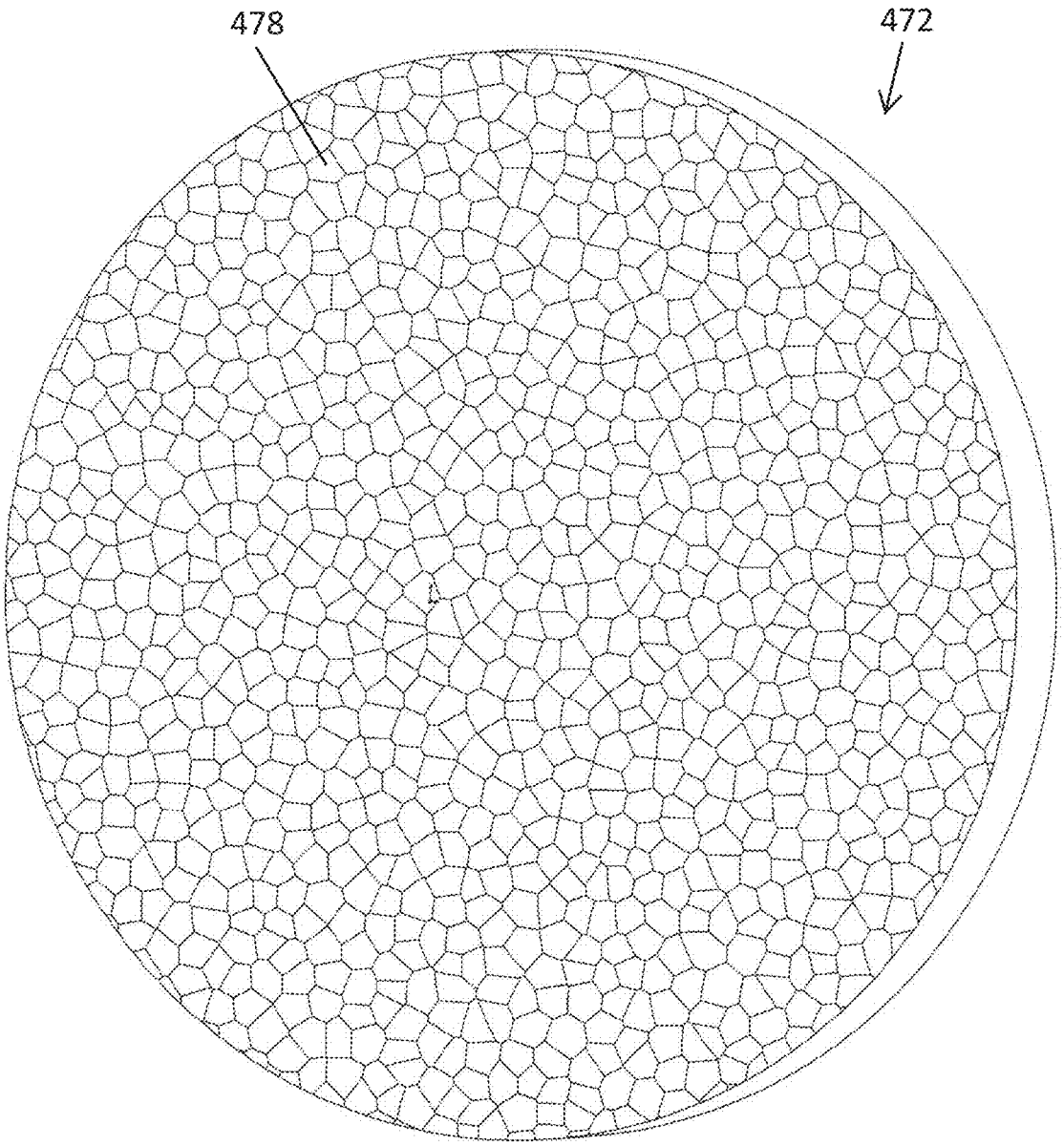
FIG. 21 is a perspective view of a tandem lens array according to another embodiment.

FIG. 19 illustrates a tandem lens array 272 according to another embodiment that can be used in place of the tandem lens array 172 described above. The tandem lens array 272 includes individual lenses 278 that have an outer perimeter in the shape of a circle rather than hexagon. The lenses 278 form a repeating hexagonal pattern. FIG. 20 illustrates another embodiment of a tandem lens array 372. The tandem lens array 372 includes lenses 378 arranged in a circular pattern around a center 373 of the tandem lens array 372. FIG. 21 illustrates a tandem lens array 472 according to yet another embodiment. The tandem lens array includes lenses 478 that have a randomly shaped arrangement.

What is claimed is:

1. A lighting fixture comprising:

a light source including an array of light emitting diodes (LEDs);

a reflector including a input end adjacent the array of LEDs and an output end opposite the input end such that the light source emits light through the reflector from the input end through the output end, the reflector further including a first, a second, a third, and a fourth sidewall that extend from the input end to the output end, the first and the second sidewalls each including an interior surface, the third and the fourth sidewalls each include an interior surface having a reflectivity that is more diffuse than the interior surfaces of the first and second sidewalls; and a lens adjacent the output end of the reflector, wherein the reflector is tapered such that the input end is smaller than the output end.

2. The lighting fixture of claim 1, wherein the reflector further includes a fifth and a sixth sidewall such that the reflector has a hexagonal cross-section.

3. The lighting fixture of claim 2, wherein the fifth and sixth sidewalls each include an interior surface, wherein the third, the fourth, and fifth sidewalls each include an interior surface having a reflectivity that is more diffuse than the interior surfaces of the first, the second, and the sixth sidewall.

4. The lighting fixture of claim 1, wherein the interior surface of the first sidewall is specular, wherein the interior surface of the second sidewall is specular, wherein the interior surface of the third sidewall includes a diffusing structure, and wherein the interior surface of the fourth sidewall includes a diffusing structure.

5. The lighting fixture of claim 4, wherein the diffusing structure includes a diffusing grain that extends along a longitudinal axis of the reflector.

6. The lighting fixture of claim 1, wherein the interior surface of the first sidewall and the interior surface of the second sidewall have a first reflectivity that is the same, and wherein the interior surface of the third sidewall and interior surface of the fourth sidewall have a second reflectivity that is the same.

7. The lighting fixture of claim 1, wherein the reflector includes a longitudinal axis that extends centrally through the input end and the output end, wherein the first, the second, the third, and the fourth sidewalls are angled relative to the longitudinal axis in a range from about 10 degrees to about 20 degrees.

8. The lighting fixture of claim 1, wherein the array includes from 40 to 90 LEDs.

9. The lighting fixture of claim 1, wherein the array includes red, lime, green, and indigo color LEDs.

10. The lighting fixture of claim 9, wherein the array consists only of red, lime, green, and indigo color LEDs.

11. The lighting fixture of claim 9, wherein the array includes from 10 to 20 red LEDs, from 10 to 20 lime LEDs, from 5 to 12 green LEDs, and from 8 to 16 indigo LEDs.

12. The lighting fixture of claim 11, wherein the array includes 12 indigo LEDs, 8 green LEDs, 16 lime LEDs, and 16 red LEDs.

13. The lighting fixture of claim 1, wherein the lens includes a tandem lens array.

14. The lighting fixture of claim 13, wherein the tandem lens array includes a first side that faces toward the array of LEDs and a second side that is opposite the first side, wherein the first side includes an array of lenses and the second side includes an array of lenses.

15. The lighting fixture of claim 1, further comprising an effects module that includes a gobo wheel.

16. The lighting fixture of claim 1, wherein the lens includes zoom projection lenses.

17. A lighting fixture comprising:

a light source including an array of light emitting diodes (LEDs);

a reflector including a input end adjacent the array of LEDs and an output end opposite the input end such that the light source emits light through the reflector from the input end through the output end, the reflector further including a first, a second, a third, and a fourth sidewall that extend from the input end to the output end, the first and the second sidewalls each including an interior surface, the third and the fourth sidewalls each include an interior surface having a reflectivity that is more diffuse than the interior surfaces of the first and second sidewalls; and a lens adjacent the output end of the reflector, wherein the interior surface of the first sidewall is specular, wherein the interior surface of the second sidewall is specular, wherein the interior surface of the third sidewall includes a diffusing structure, and wherein the interior surface of the fourth sidewall includes a diffusing structure, wherein the diffusing structure includes a diffusing grain that extends along a longitudinal axis of the reflector.

18. The lighting fixture of claim 17, wherein the reflector includes a housing, and wherein the first, the second, the third, and the fourth sidewalls are fixed to an inside of the housing.

19. The lighting fixture of claim 17, wherein the reflector includes a longitudinal axis that extends centrally through the input end and the output end, wherein the first, the second, the third, and the fourth sidewalls are angled relative to the longitudinal axis in a range from about 10 degrees to about 20 degrees.

20. The lighting fixture of claim 19, wherein the array includes from 10 to 20 red LEDs, from 10 to 20 lime LEDs, from 5 to 12 green LEDs, and from 8 to 16 indigo LEDs.

* * * * *